United States Patent [19]

Saito

[11] 4,386,332

[45] May 31, 1983

[54] MAGNETIC CIRCUIT FOR DYNAMIC SPEAKER

[75] Inventor: Tatsuo Saito, Saitama, Japan

[73] Assignee: Pioneer Electronic Corporation, Tokorozawa, Japan

[21] Appl. No.: 288,875

[22] Filed: Jul. 31, 1981

[30] Foreign Application Priority Data

Aug. 1, 1980 [JP] Japan ..... 55-108285[U]

[51] Int. Cl.[3] ..... H01H 7/08; H04R 9/02

[52] U.S. Cl. ..... 335/231; 179/115.5 PC

[58] Field of Search ..... 335/231; 179/115.5 R, 179/115.5 PC

[56] References Cited

U.S. PATENT DOCUMENTS 3,679,844 7/1972 Derkacz ..... 335/231

*Primary Examiner*—Harold Broome

*Attorney, Agent, or Firm*—Sughrue, Mion, Zinn, Macpeak and Seas

[57] ABSTRACT

A magnetic circuit for a dynamic speaker which can be manufactured inexpensively without the need of machining. The magnetic circuit includes an annularly-shaped magnet, a pole yoke having a backplate coupled to a first surface of the magnet and a pole yoke extending from a central portion of the back plate through a hole in the annularly-shaped magnet, and an annular top plate coupled to a second surface of the magnet with an air gap being formed between the top plate and the center pole. A tapered groove is formed in the back plate along a circumferential direction of the base of the center pole tapering outwardly toward the magnet. The groove extends beyond a region defined by the inner diameter of the magnet.

2 Claims, 3 Drawing Figures

MAGNETIC CIRCUIT FOR DYNAMIC SPEAKER

BACKGROUND OF THE INVENTION

The present invention relates to a magnetic circuit for a dynamic speaker. More particularly, the invention relates to an external magnet type magnetic circuit including an annularly- shaped magnet, a pole yoke having a back plate coupled to one surface of the magnet and a center pole extending from the central portion of the back plate and passing through a hole in the annularly-shaped magnet, and an annularly-shaped top plate coupled to the other surface of the magnet, in which an air gap is provided between the center pole and the top plate.

Prior art external magnet type magnetic circuits are shown in FIGS. 1A and 1B. In the magnetic circuit shown in FIG. 1A, the lower surface of a back plate 2*a* of a pole yoke 2 is flat while a stepped portion 2*a'* is formed in the upper surface of the back plate 2*a* to determine the position of the magnet 1. An air gap is provided between a top plate 3 coupled to the upper surface of the magnet 1 and a center pole 2*b* of the pole yoke 2.

The structure of this magnetic circuit is disadvantageous in that the thickness of the magnet must be increased as the length of the air gap is increased and hence as the circuit is made more effective. In order to resolve such a disadvantage, a magnetic circuit as shown in FIG. 1B has been proposed in which the back plate 2*a* protrudes downwardly at the base portion of the center pole 2*b* and a groove 2*c* is formed in the back plate 2*a* along the circumferential direction of the center pole 2*b*. According to the magnetic circuit thus constructed, the length of the air gap 4 in the moving direction of the voice coil (not shown) is advantageously increased without increasing the thickness of the magnet 1. Denoted by 2*a''* is a protruding portion provided to facilitate the positioning of the magnet 1.

On the other hand, the magnetic circuit shown in FIG. 1B is disadvantageous due to leakage of the magnetic flux. Specifically, there exists leakage magnetic flux extending from the lower surface of the top plate 3 to the surface of the protruding portion 2*a''* or to the pole yoke 2*b*.

Recently, a strontium ferrite magnet has been employed in this type of magnetic circuit, which provides a stronger magnetic flux in comparison with a conventionally used barium ferrite magnet. If such a strontium ferrite magnet is used in the magnetic circuit in FIG. 1B, the thickness of the magnet can further be decreased while maintaining the strength of the magnetic field in the air gap substantially constant. However, leakage of the magnetic flux then becomes significant. In addition, there is a further disadvantage in the structure of FIG. 1B in that the outer diameter of the magnet must be increased because the groove 2*c* and the protruding portion 2*a''* are formed inside the inner diameter of the magnet 1. Although the recent fabrication techniques for the magnet do not necessarily require such a protruding portion 2*a''*, the same disadvantage still remains due to the presence of the groove 2*c*. To shorten the outer diameter of the magnet thus minimizing the magnet volume, the width of the groove 2*c* must be made shorter than the depth of the groove 2*c*. In the press-molding of the pole yoke 2, the groove 2*c* is also concurrently molded. If the mold die used is formed with a corresponding groove 2*c*, the die portion used to mold the groove 2*c* becomes thin and is hence liable to be damaged. For this reason, a cutting machine is practically used to form the groove 2*c*. The use of the cutting machine, however, increases the manufacturing cost and number of manufacturing steps. Further, the cut-out portion of the material is wasted. Consequently, the magnetic circuit thus manufactured is expensive.

SUMMARY OF THE INVENTION

Accordingly, an object of the invention is to provide a magnetic circuit which can be manufactured inexpensively without the need of machining.

In order to achieve this object, a groove formed along the circumferential direction of the base portion of the center pole is provided with a tapered side wall which extends beyond a region defined by the inner diameter of a magnet. The formation of such a groove is enabled due to the fact that the density of the magnetic flux in the air gap is not lowered. In fact the density thereof is increased in the case when a thin magnet is used.

DESCRIPTION OF THE PREFERRED EMBODIMENTS

Figure 1A:
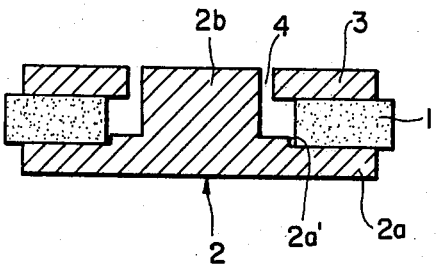
FIG. 1A PRIOR ART
FIGS. 1A and 1B are cross-sectional view showing prior art magnetic circuts.
Figure 1B:
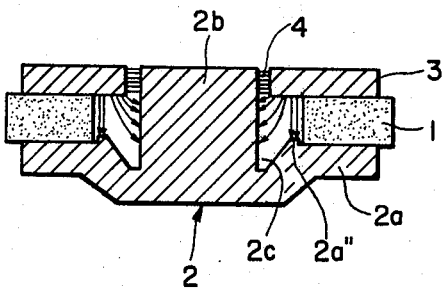
FIG. 1B PRIOR ART
Figure 2:
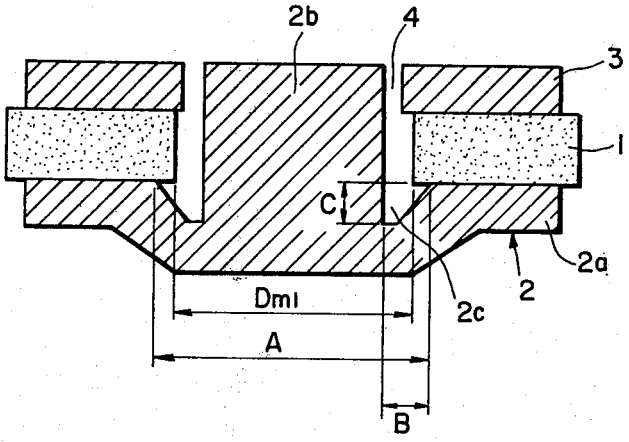
FIG. 2 is a cross-sectional view showing a magnetic circuit according to the invention.

A preferred embodiment of a magnetic circuit according to the invention will be described with reference to FIG. 2 in which like components or like parts shown in FIGS. 1A and 1B are denoted by like reference numerals or like symbols. In FIG. 2, the groove 2*c* has a tapered side wall similar to that shown in FIG. 1B. However, the outermost diameter A of the groove 2*c* is made to be larger than the inner diameter $D_{mi}$ of the magnet 1. In other words, the tapered side wall of the groove 2*c* extends beyond an area defined by the inner diameter $D_{mi}$ of the magnet 1.

According to experiments, it has found that the magnetic flux substantially does not vary if the diameter A is approximately 1.25 times as large as the inner diameter $D_{mi}$ of the magnet 1. The experimental results are shown in the following Table.

TABLE

| DIAMETER OF CENTER (mm) POLE | A (mm) | $D_{mi}$ (mm) | $\Phi_g$ | $A/D_{mi}$ |
|---|---|---|---|---|
| 47.47 | 56 | 60 | 116.000 | 0.933 |
| " | 64 | 60 | 116.000 | 1.066 |
| 75.9 | 86.5 | 95 | 132.000 | 0.91 |
| " | 98 | 95 | 132.000 | 1.03 |
| 24.95 | 29.5 | 32 | 38.000 | 0.92 |
| " | 40 | 32 | 38.000 | 1.25 |
| 35.31 | 42 | 45 | 67.000 | 0.933 |
| " | 52 | 45 | 67.000 | 1.16 |

As described, by setting the outermost diameter A of the groove 2*c* within a limited range, the width B of the groove 2*c* is increased. As a result, the requirement that the width B of the groove 2*c* be larger than or equal to the depth C of the groove 2*c* is satisfied so that molding of the groove 2*c* by cold forging techniques can be performed.

In accordance with the invention, since a groove formed along the circumferential direction of the base portion of the center pole has a tapered side wall which extends beyond the region defined by the inner diameter of the magnet, the width of the groove can be increased without increasing the size of the magnet. Accordingly, the protrusion of the mold which corresponds to the groove of the back plate can be formed with a smooth tapered surface, whereby the groove can be molded by cold forging concurrently with molding the back plate. Further, the durability of the mold is enhanced. Moreover, the manufacturing cost and the number of manufacturing steps are reduced, and, in addition, there is no wasted material. Consequently, the manufacturing cost of the magnetic circuit is lowered. Moreover, if a strontium ferrite magnet is employed which is thinner than a conventional barium ferrite magnet, the leakage of the magnetic flux extending from the top plate to the back plate and/or the pole yoke is reduced, whereby the density of the magnetic flux in the air gap is increased.

What is claimed is:

1. A magnetic circuit for a dynamic speaker comprising:

an annularly-shaped magnet;

a one piece pole yoke having a back plate coupled to a first surface of said magnet and a center pole extending from a central portion of said back plate passing through a hole in said annularly-shaped magnet; and an annular top plate coupled to a second surface of said magnet, an air gap being provided between said top plate and said center pole and a tapered groove being formed in said back plate circumferentially of the base of said center pole tapering outwardly toward said magnet, said groove extending beyond a region defined by an inner diameter of said magnet with the outer diameter of the groove being approximately 1.25 times the inner diameter of said magnet and the width of said groove being equal to or larger than the depth of said groove.

2. The magnetic circuit as recited in claim 1 wherein said magnet is made of strontium ferrite.

* * * * *